US008256937B2

(12) United States Patent
Bleyle et al.

(10) Patent No.: US 8,256,937 B2
(45) Date of Patent: Sep. 4, 2012

(54) DRAWING ASSEMBLY WITH REPOSITIONABLE LIGHT

(75) Inventors: Kyle Bleyle, Alden, NY (US); Ray Cappello, Orchard Park, NY (US); Ken Temple, Strykersville, NY (US)

(73) Assignee: Mattel, Inc., El Segundo, CA (US)

( * ) Notice: Subject to any disclaimer, the term of this patent is extended or adjusted under 35 U.S.C. 154(b) by 395 days.

(21) Appl. No.: 12/547,785

(22) Filed: Aug. 26, 2009

(65) Prior Publication Data

US 2011/0051436 A1 Mar. 3, 2011

(51) Int. Cl.
*F21V 21/30* (2006.01)

(52) U.S. Cl. ..... 362/427; 362/98; 362/287

(58) Field of Classification Search ..... 362/97.4, 362/98, 99, 287, 427; 446/146; 108/23; 345/180, 181, 182, 183
See application file for complete search history.

(56) References Cited

U.S. PATENT DOCUMENTS

| | | | | |
|---|---|---|---|---|
| 2,883,770 | A | 4/1959 | Lieb | |
| 2,917,838 | A | 12/1959 | Neugass | |
| 3,232,685 | A | 2/1966 | Wilstein et al. | |
| 3,781,536 | A | 12/1973 | Naeseth et al. | |
| 4,234,908 | A | 11/1980 | McGee | |
| 4,265,624 | A | 5/1981 | Krulwich | |
| 4,312,507 | A | 1/1982 | Smith et al. | |
| 4,464,118 | A | 8/1984 | Scott et al. | |
| 4,586,440 | A | 5/1986 | Avella | |
| 4,654,762 | A * | 3/1987 | Laverick | 108/23 |
| 4,700,634 | A | 10/1987 | Mills et al. | |
| 4,751,620 | A | 6/1988 | Wright et al. | |
| 5,149,184 | A * | 9/1992 | Hughes et al. | 362/287 |
| 5,176,438 | A | 1/1993 | Fisherman | |
| 6,422,715 | B2 | 7/2002 | Naghi et al. | |
| 6,517,355 | B1 * | 2/2003 | Long et al. | 434/409 |
| 6,533,431 | B2 | 3/2003 | Leifer et al. | |
| 6,634,763 | B1 | 10/2003 | Leifer et al. | |
| 6,672,557 | B1 | 1/2004 | Jackson | |
| 6,749,314 | B2 | 6/2004 | Naghi et al. | |
| 6,851,819 | B2 | 2/2005 | Naghi et al. | |
| 6,851,822 | B2 | 2/2005 | Herrera | |
| 7,153,212 | B1 | 12/2006 | Karten et al. | |
| 7,465,057 | B2 | 12/2008 | Sandy | |
| 2003/0179572 | A1 | 9/2003 | Schnell | |
| 2008/0031001 | A1 * | 2/2008 | Sun | 362/427 |
| 2008/0266835 | A1 | 10/2008 | Chang | |

FOREIGN PATENT DOCUMENTS

JP 2003195772 A 7/2003

* cited by examiner

*Primary Examiner* — Y My Quach Lee
(74) *Attorney, Agent, or Firm* — Edell, Shapiro & Finnan, LLC

(57) ABSTRACT

A drawing assembly for children includes a housing having a drawing surface and an illumination assembly pivotally connected to the housing and movable between a storage position within a recess in the housing, and a deployed position. The illumination assembly includes an illumination source that is positionable to provide illumination to the drawing surface when in the deployed position.

18 Claims, 13 Drawing Sheets

DRAWING ASSEMBLY WITH REPOSITIONABLE LIGHT

FIELD OF THE INVENTION

The present invention relates to a drawing device and in particular, to a child's drawing device that includes a housing having a drawing surface and an illumination assembly coupled to the housing and pivotally movable between a storage position and a deployed position.

BACKGROUND OF THE INVENTION

Various drawing or creativity devices and stations have been proposed for use by children to draw, color, paint or engage in other such activities. Many such devices include a planar surface on which the child can place a sheet of paper or other material, and create images thereon using various media (crayon, pencil, marker, etc.). Magnetic drawing devices including a stylus operably associated with a magnetic drawing surface for creating images thereon are also known, such as for example the magnetic drawing devices sold by Fisher-Price, Inc. under the trademark Doodle Pro®. It is often desirable that a drawing device be portable, so that a child may easily carry the device and use the device at various locations. However, sufficient light must be present to use the device. Attempts to provide portable lights are often inconvenient or unusable with many drawing devices, particularly children's drawing devices.

There is a need for a portable drawing assembly that includes an illumination source, which may be easily moved or repositioned between a storage position and a use position on the drawing assembly.

SUMMARY OF THE INVENTION

The present invention relates to a drawing assembly including a housing having a drawing surface and an illumination assembly pivotally connected to the housing and movable between a storage position and a deployed position.

In one embodiment, the present invention relates to drawing assembly including a housing having a first surface including a drawing surface and a second surface opposite the first surface, an illumination casing, and an illumination source disposed within the illumination casing. The illumination casing has a first end pivotally connected proximate to an edge portion of the housing, and is pivotable through an arcuate path of approximately 270°. An illumination source is disposed within the illumination casing and is positionable to provide illumination to the drawing surface.

In one embodiment, the second surface of the housing includes a recess disposed therein. The illumination casing is pivotally movable between a storage position within the recess and a deployed position out of the recess.

In one implementation, the drawing surface is located along a first plane, the illumination casing includes a front face located along a second plane, and the first plane is substantially perpendicular to the second plane when the illumination casing is in its deployed position. In another implementation, the drawing surface is located along a first plane, the illumination casing includes a front face located along a second plane, and the first plane is substantially parallel to the second plane when the illumination casing is in its storage position. In another implementation, the first surface of the housing is located along on a first plane, and the illumination casing is pivotable about an axis that is substantially parallel to the first plane. In another implementation, the second surface of the housing is located along a second plane, and the axis is intermediate the first plane and the second plane.

In one embodiment, the housing also includes a detent mechanism that releasably retains the illumination casing in a selected position along the arcuate path. In another embodiment, the detent mechanism releasably retains the casing in at least one of a storage position or a deployed position.

In one embodiment, the drawing surface is a magnetic drawing surface, and the drawing assembly further includes a drawing implement operably associated with the magnetic drawing surface for creating images thereon.

In one embodiment, the illumination casing is in its storage position is placed within the housing.

In another embodiment, the present invention relates to a drawing assembly including a housing having a first side and a second side opposite to the first side, a drawing surface disposed on the first side and a recess disposed in the second side, and the housing including an edge portion. A casing is pivotally connected to the edge portion of the housing and movable between a storage position within the recess and a deployed position. An illumination source is coupled to the casing, and illuminates at least a portion of the drawing surface when the casing is in its deployed position.

In one implementation, the drawing surface is located along on a first plane, and the casing is pivotable about an axis that is substantially parallel to the first plane. In another implementation, the second surface of the housing is located along a second plane, and the axis is intermediate the first plane and the second plane.

In another embodiment, the present invention relates to a magnetic drawing assembly. The magnetic drawing assembly includes a housing having a top surface located along a first plane and an opposite bottom surface located along a second plane, the top surface including a magnetic drawing surface, and the bottom surface including a recess formed therein. A magnetic drawing implement is provided, which is operably associated with the magnetic drawing surface for creating images thereon. An illumination assembly is movably connected to an edge portion of the housing and rotatable about an axis, the axis being intermediate the first plane and the second plane.

In one embodiment, the illumination assembly includes a casing and an illumination source. The casing is pivotally connected to the edge portion of the housing and movable between a storage position within the recess and a use position. The illumination source illuminates at least a portion of the magnetic drawing surface when the casing is in its use position.

In one implementation, the illumination assembly includes a front face located along a fourth plane, and the first plane is substantially perpendicular to the fourth plane when the illumination assembly is in its use position.

In one embodiment, the casing of the magnetic drawing assembly is rotatable relative to the housing through an arcuate path of approximately 270°.

In one embodiment, the housing of the magnetic drawing assembly includes a detent mechanism that releasably retains the illumination assembly in at least a first selected position.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
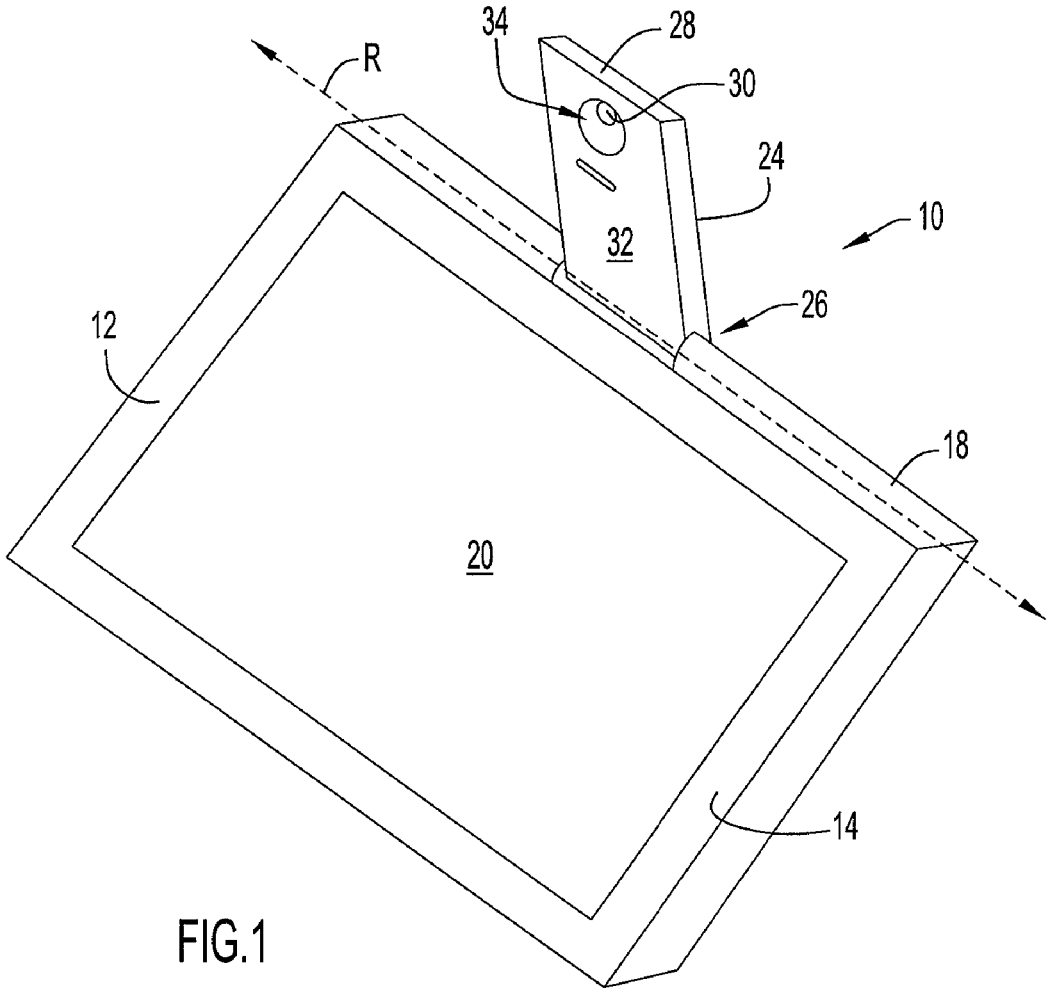
FIG. 1 illustrates a top perspective view of a drawing assembly according to an embodiment of the present invention.
Figure 2:
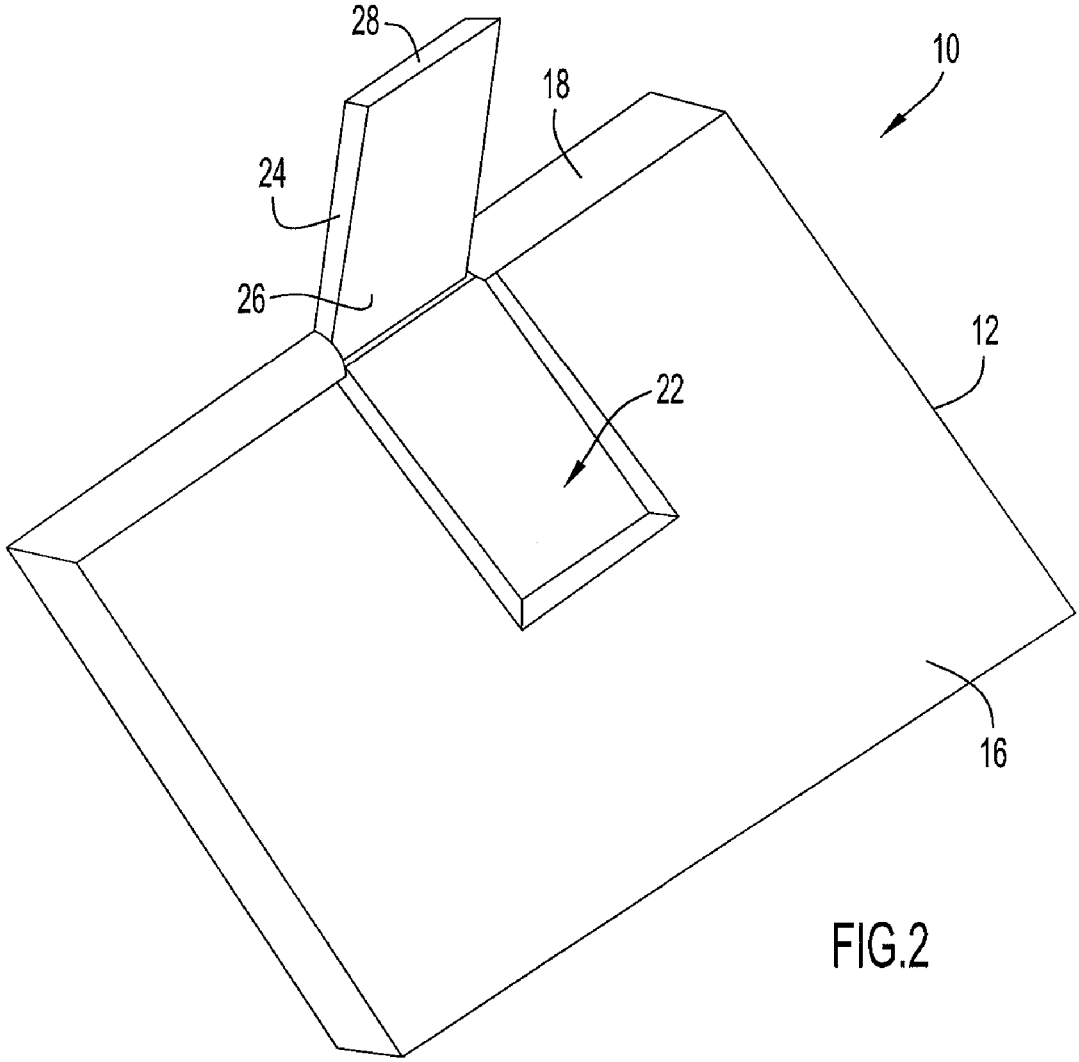
FIG. 2 illustrates a bottom perspective view of the drawing assembly of FIG. 1.
Figure 3:
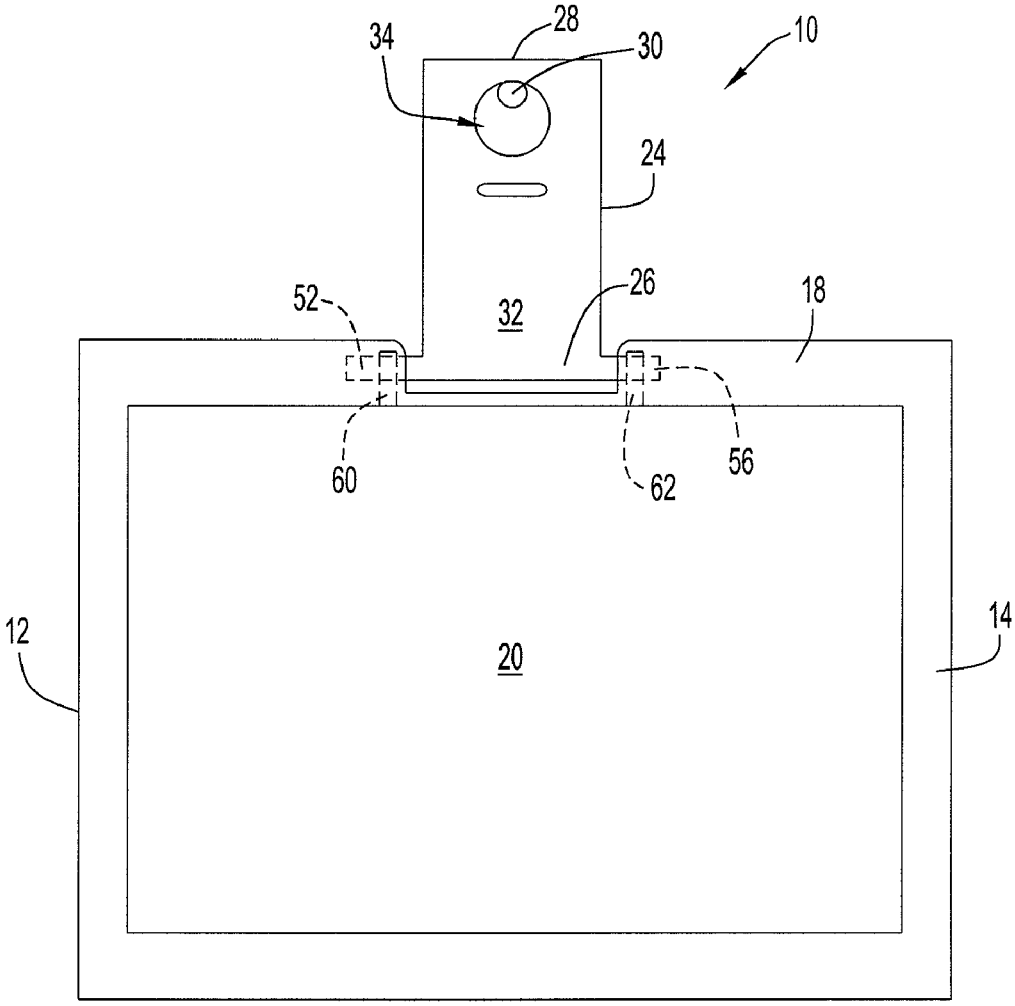
FIG. 3 illustrates a top plan view of the drawing assembly of FIG. 1 with portions of a housing and a casing shown in phantom.

Referring to FIGS. 1-4, a drawing assembly 10 according to an embodiment of the present invention is illustrated. The drawing assembly 10 includes a housing 12 having a first surface 14, a second surface 16 opposite to the first surface 14, and an edge portion 18. A drawing surface 20 is disposed on the first surface 14, as best shown in FIGS. 1 and 3. A recess 22 is disposed in the second surface 16, as best shown in FIG. 2.

Figure 4:
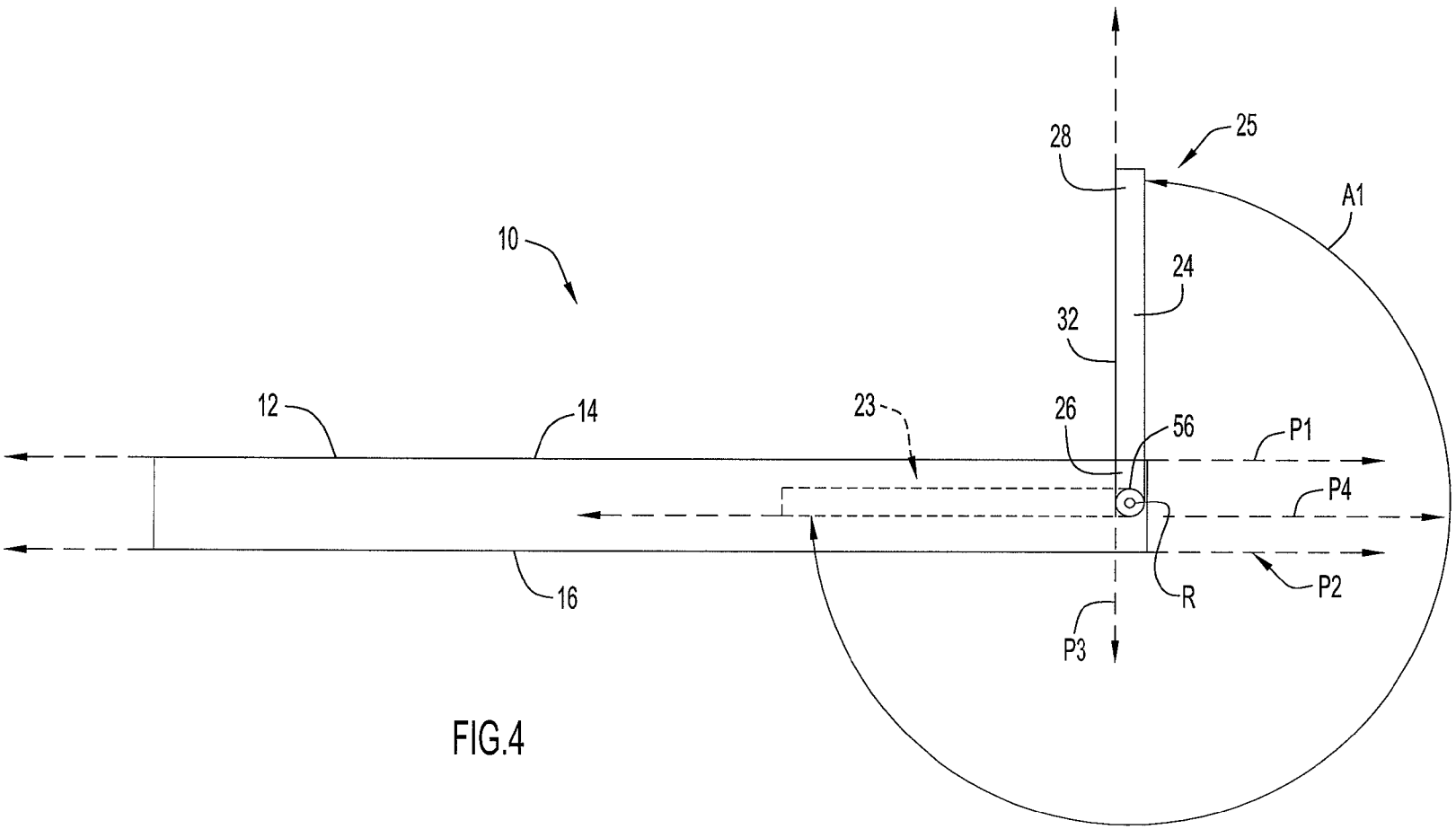
FIG. 4 illustrates a side view of the drawing assembly of FIG. 1 with the casing in a deployed position, and showing the casing in a storage position in phantom.

A casing 24 is pivotally connected proximate to the edge portion 18 of the housing 12, and movable between a storage position 23 within the recess 22 (shown in phantom in FIG. 4), and a deployed position 25 out of the recess 22 (shown in solid line in FIG. 4). The casing 24 includes a first end portion 26 and a second end portion 28 distal to the first end portion 26. The first end portion 26 is pivotally connected proximate to the edge portion 18 of the housing 12. The second end portion 28 of the casing 24 may traverse an arcuate path of approximately 270°, as shown by arrow A1 in FIG. 4, when pivoted between the storage position 23 and the deployed position 25.

An illumination source 30 is coupled to the casing 24, and illuminates at least a portion of the drawing surface 20 when the casing 24 is in its deployed position 25. By way of example, the illumination source 30 may comprise one or more light-emitting elements including, but not limited to, light emitting diodes (LEDs) and/or grain of wheat bulbs (GOWs). In this embodiment, the illumination source 30 is disposed within the casing 24, recessed from or coplanar with a front face 32 of the casing 24 in order to minimize unintended contact with or damage to the illumination source 30. For example, a depression 34 may extend into the front face 32 of the casing, and the illumination source 30 may be disposed within the depression 34. In some embodiments, the depression 34 may have a generally conical configuration for enhanced light dispersion. The depression 34 and/or the illumination source 30 are proximate to the second end portion 28 of the casing 24 in order to further maximize light dispersion. The illumination source 30 may be selectively positioned by pivoting the casing 24 to provide illumination to the drawing surface 20.

Referring to FIGS. 1 and 4, the first surface 14 may be located along a first plane P1, and the second surface 16 may be located along a second plane P2 spaced from and parallel to the first plane P1. The first end portion 26 of the casing 24 is pivotable about an axis of rotation R that is substantially parallel to the first plane P1. In one embodiment, the axis R is intermediate the first plane P1 and the second plane P2. When the casing 24 is in its deployed position 25, the front face 32 of the casing 24 may be located along a third plane P3 that is substantially perpendicular to the first plane P1 (and/or the second plane P2). When the casing 24 is in its storage position, the front face 32 of the casing 24 may be located along a fourth plane P4 that is substantially parallel to the first plane P1 (and/or the second plane P2). In alternative embodiments, the axis R is located within the first plane P1 or the second plane P2.

Figure 5:
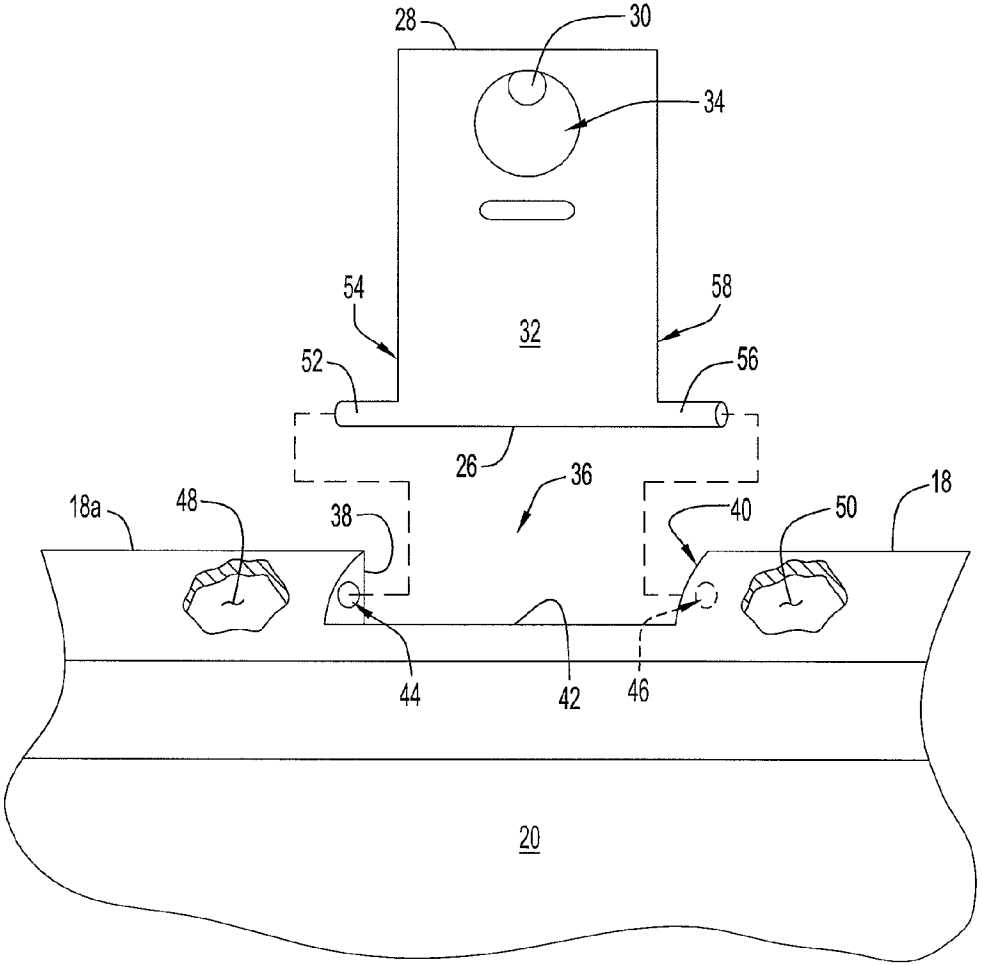
FIG. 5 illustrates a fragmentary assembly view of portions of the drawing assembly of FIG. 1.

Referring to FIG. 5, the edge portion 18 may include a cutout portion 36 extending inwardly and toward the drawing surface 20. The cutout portion 36 is defined by a first side 38, a second side 40 opposite the first side 38, and an inner surface 42 extending therebetween. A first opening 44 is disposed in the first side 38, and a second opening 46 (shown in phantom) is disposed in the second side 40. Edge portion 18 defines a first cavity 48 proximate the first side 38 of the cutout portion 36 and accessible through the first opening 44, and a second cavity 50 proximate the second side 40 of the cutout portion 36 and accessible through the second opening 46.

The casing 24 may include a first pivot post 52 extending outwardly from a first side 54 thereof and proximate the first end portion 26. Casing 24 may include a second pivot post 56 extending outwardly from a second side 58 thereof and proximate the first end portion 26. The first pivot post 52 is rotatably received in the first opening 44 and is retained within the first cavity 48, and the second pivot post 56 is rotatably received in the second opening 46 and is retained within the second cavity 50. The first pivot post 52 may be rotatably connected to and supported by a first bracket 60 disposed within the first cavity 48, and the second pivot post 56 may be rotatably connected to and supported by a second bracket 62 disposed within the second cavity 50, as shown in phantom in FIG. 3. In this way, the casing 24 is rotatably connected to the edge portion 18.

Referring again to FIGS. 4 and 5, the axis of rotation R of the casing 24 relative to the housing 12 may be coaxial with the longitudinal axis of the first and second pivot posts 52, 56, as well as the centers of the first and second openings 44, 46. Given the axis of rotation R is disposed within the cutout portion 36, and spaced from a periphery 18*a* (see FIG. 5) of the edge portion 18, the casing 24 does not extend outwardly from the periphery 18*a* when in the storage position, as shown in phantom in FIG. 4. Thus, the possibility of damaging the casing 24 and/or illumination source 30 when in the storage position is minimized.

Figure 6:
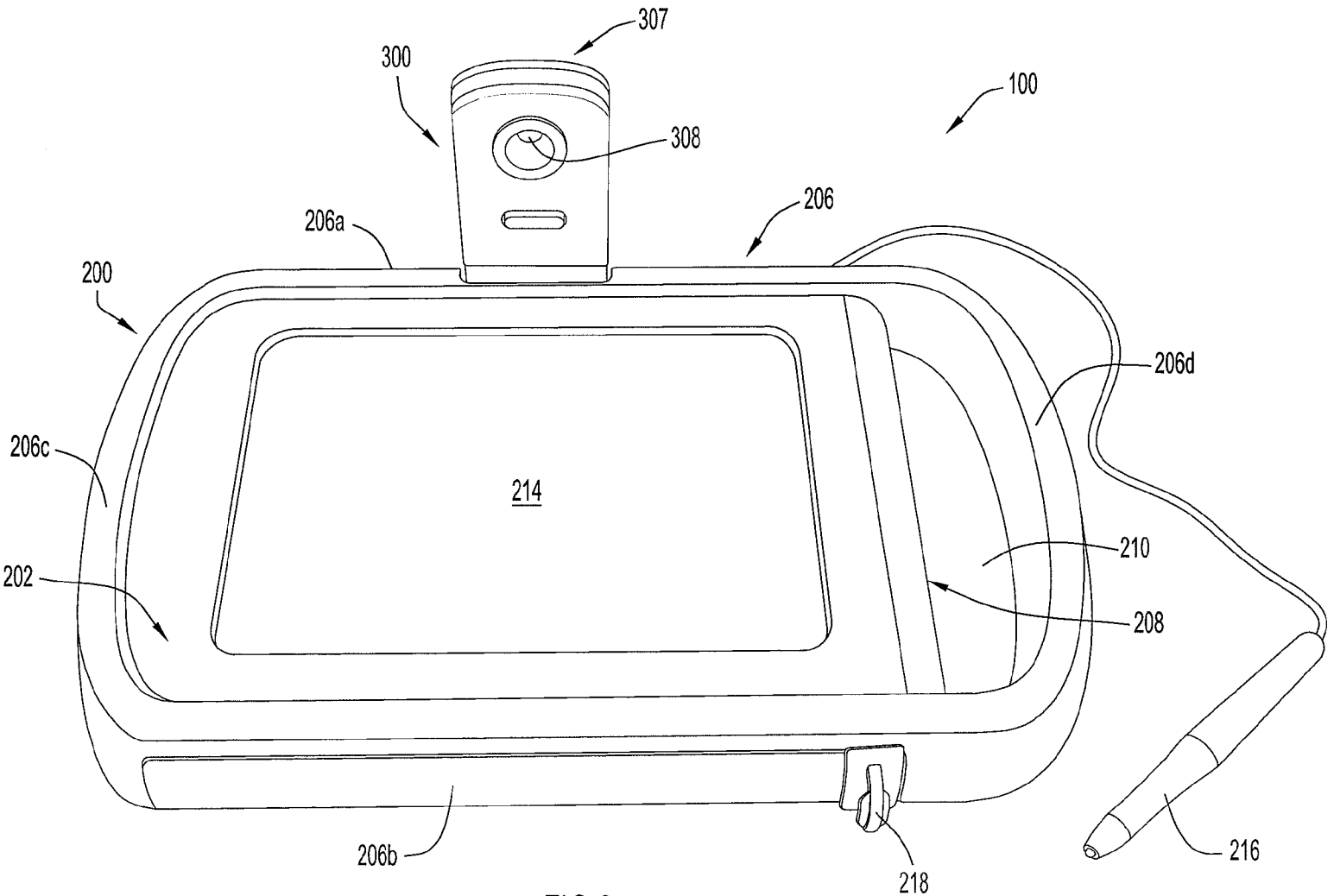
FIG. 6 illustrates a top perspective view of a drawing assembly according to another embodiment.
Figure 7:
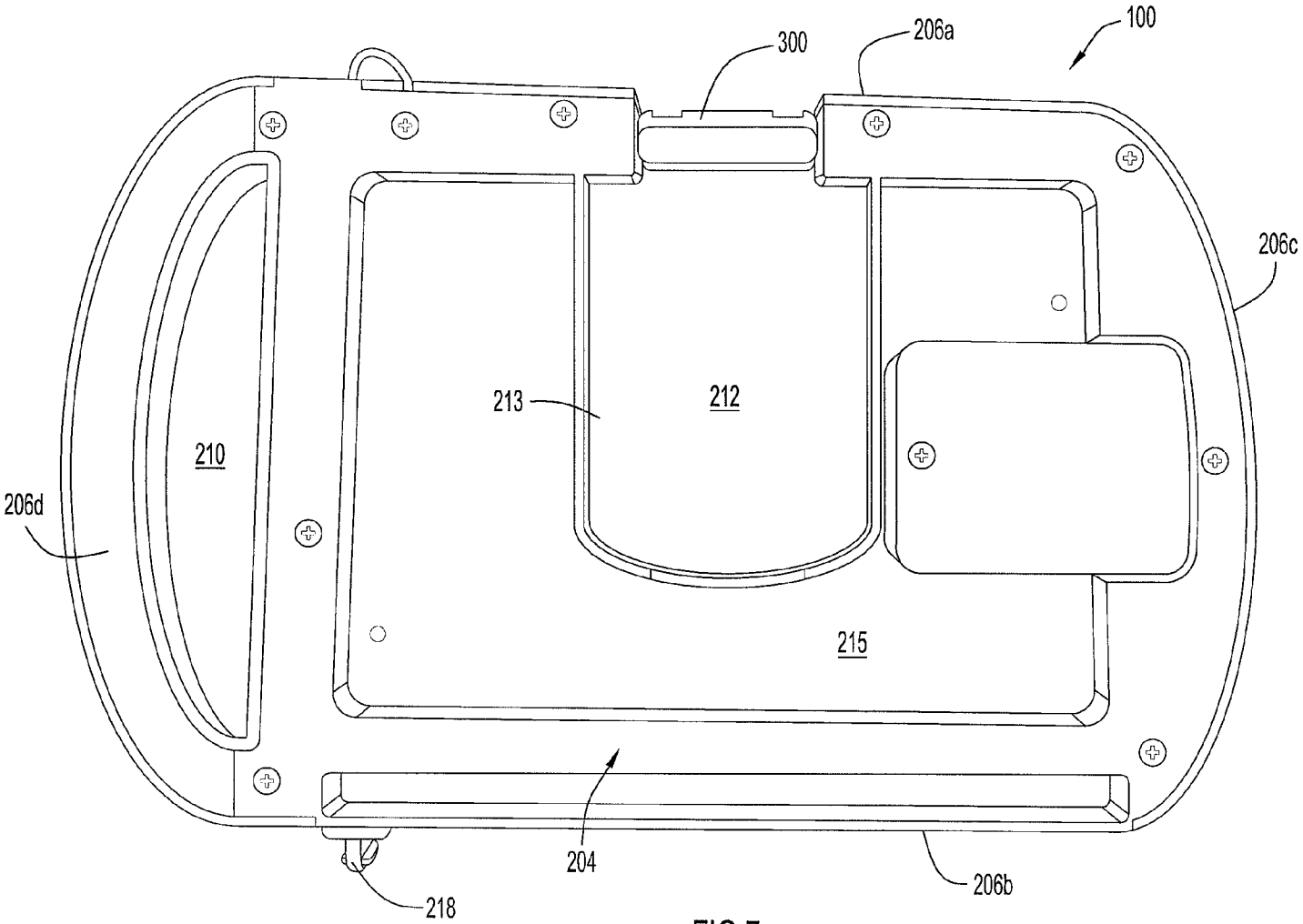
FIG. 7 illustrates a bottom plan view of the drawing assembly of FIG. 6.

Referring to FIGS. 6 and 7, an embodiment of a drawing assembly 100 according to the present invention is illustrated. In this embodiment, the drawing assembly 100 includes a housing 200 and an illumination assembly 300 moveably coupled to the housing 200.

The housing 200 includes a top surface 202, an opposite bottom surface 204, and an edge portion 206 extending between and interconnecting the top surface 202 and the bottom surface 204. The edge portion 206 may include an upper edge portion 206*a*, a lower edge portion 206*b*, a left edge portion 206*c*, and a right edge portion 206*d*. One or more of the edge portions 206*a*-206*d* may be spaced from a periphery 208 of the top surface 202 to define a gap 210 therebetween. For example, as shown in FIG. 6, in this embodiment the right edge portion 206*d* may be spaced from the periphery 208 to define the gap 210. The right edge portion 206*d* functions as a handle, whereby the gap 210 accommodates a user's fingers when the user grasps the right edge portion 206*d*. Other edge portions 206*a*-206*c* may also be spaced from the top surface 202 to define more than one gap 210 for the drawing assembly 100. For example, opposing left and right edge portions 206*c*, 206*d* may be spaced from the top surface 202 to define opposing gaps, and thus two opposing handles on the housing 200. Alternatively, no gaps and/or handles may be provided on the housing 200.

The housing 200 may have a generally rectangular configuration, as depicted in the figures. However, the illustrated configuration is exemplary only. Accordingly, the housing 200 may have other configurations, e.g. circular, oval, square, triangular, etc. in other embodiments.

The bottom surface 204 of the housing 200 includes a recess 212 formed therein, which is configured to receive the illumination assembly 300 when it is in a storage position, discussed in further detail below. In its storage position, the illumination assembly 300 is located within the housing 200. The recess 212 may be defined by a wall 213 extending upwardly from a recessed portion 215. An upper edge of the wall 213 is coplanar with the bottom surface 204 in this embodiment.

The top surface 202 defines or includes a drawing surface. In one embodiment, the top surface 202 includes a magnetic drawing surface 214. A magnetic drawing implement 216 is provided, which is operably associated with the magnetic drawing surface 214 for creating images thereon. An exemplary magnetic drawing surface 214 is similar to that sold by Fisher-Price, Inc. under the trademark Doodle Pro®. Generally, the magnetic drawing surface 214 includes a dispersing fluid loaded with magnetic particles and contained between two opposed transparent or translucent sheets and compartmentalized in a hexagonal grid. The magnetic drawing implement 216 includes a magnetized tip. When the magnetized tip of the magnetic drawing implement 216 is applied to the magnetic drawing surface 214, the magnetic particles are pulled to the front of the magnetic drawing surface 214 to create a visual image thereon. The magnetic drawing surface 214 may then be "erased" by passing a magnet disposed within the housing across the rear of the magnetic drawing surface 214, thereby pulling the magnetic particles away from the front of the magnetic drawing surface 214. An eraser handle 218 configured to be grasped by the user is coupled to the erasing magnet, and slidable along a slot extending along the edge portion 206, such as the lower edge portion 206*b*, thereby "erasing" any visual images created on the front of the magnetic drawing surface 214.

Figure 8:
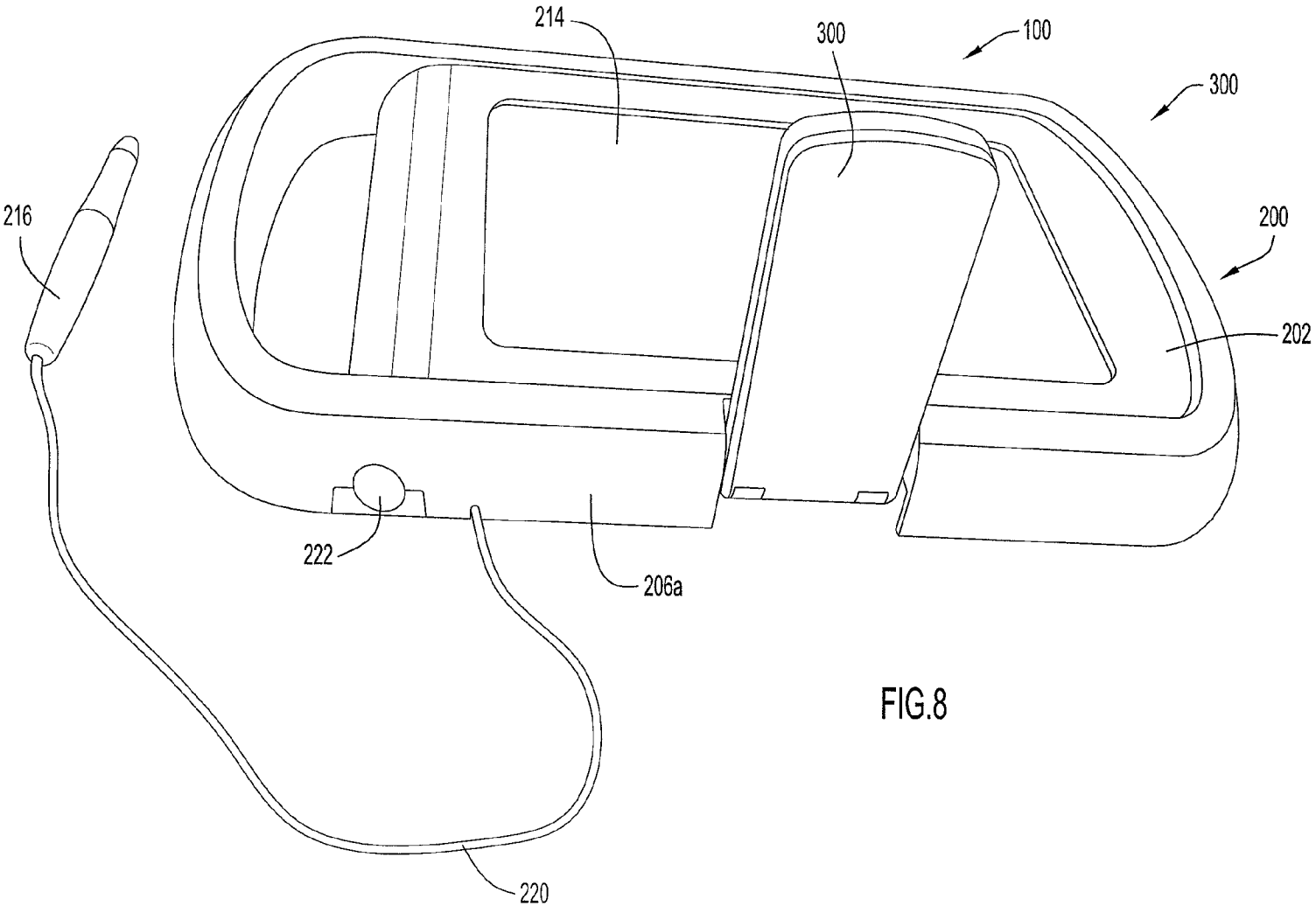
FIG. 8 illustrates a rear perspective view of the drawing assembly of FIG. 6.
Figure 9:
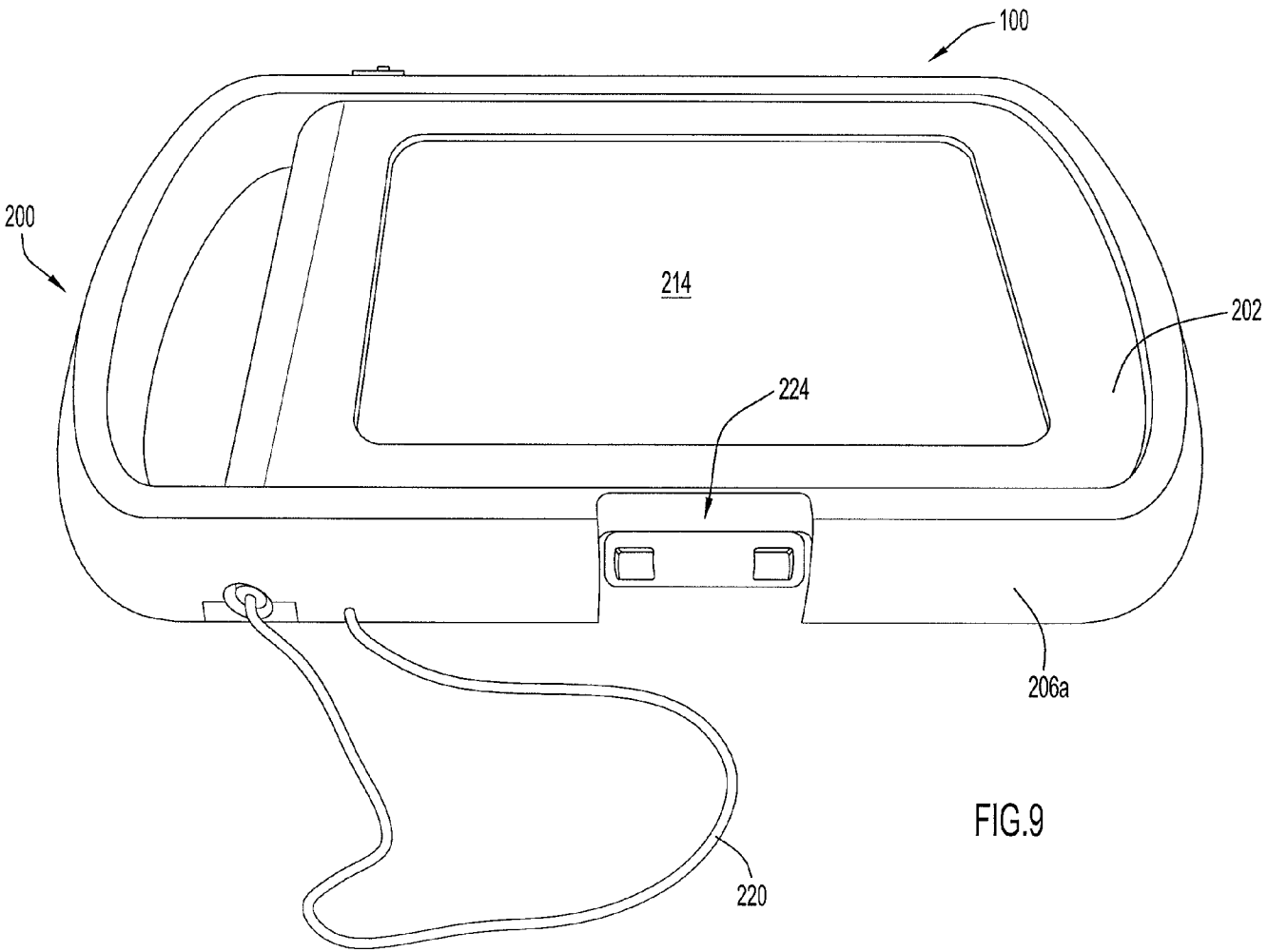
FIG. 9 illustrates another rear perspective view of the drawing assembly of FIG. 6, showing an illumination assembly in a storage position and a stylus in a storage compartment.

Referring to FIGS. 8 and 9, the drawing implement 216 may be tethered to the housing 200 via a flexible cord 220, and may be removably received in a stylus slot 222 provided in the housing 200 when not in use. In one embodiment, the stylus slot 222 is configured as a bore extending into the upper edge 206*a* and intermediate the top surface 202 and the bottom surface 204.

Figure 10:
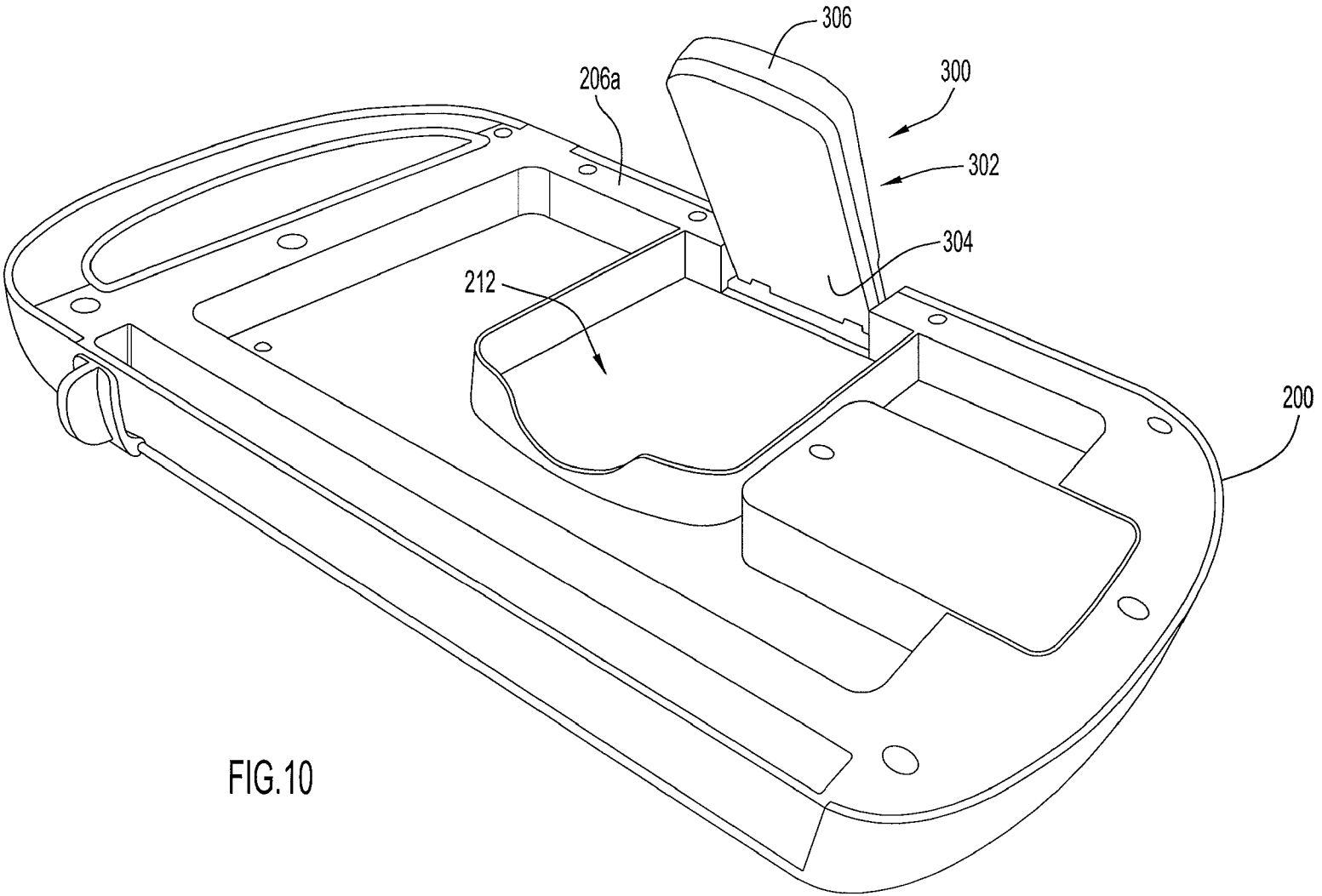
FIG. 10 illustrations a bottom perspective view of the drawing assembly of FIG. 6 showing the illumination assembly in an orientation intermediate the use position and the storage position.
Figure 11:
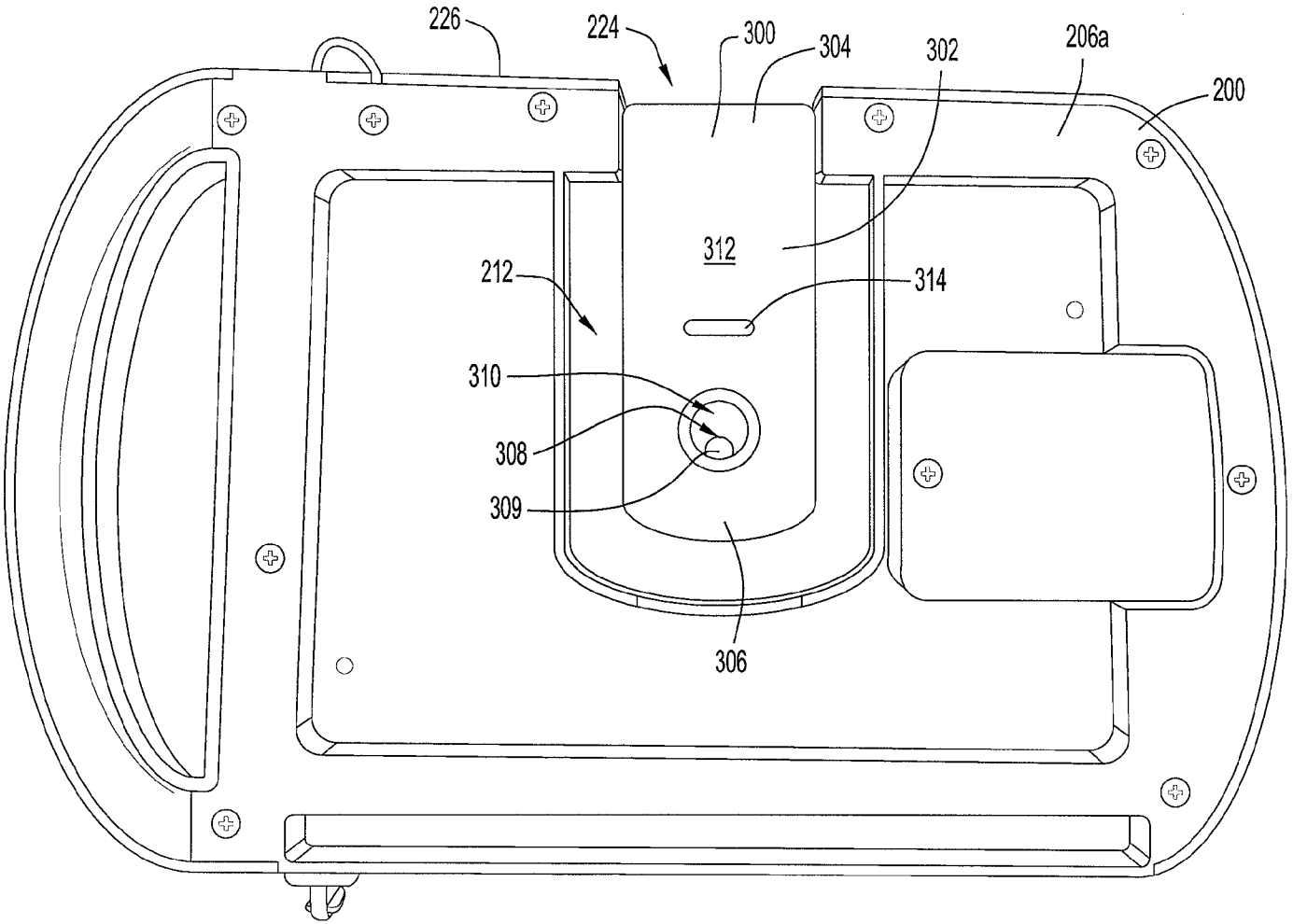
FIG. 11 illustrates a bottom plan view of the drawing assembly of FIG. 6 showing the illumination assembly in the storage position.

Referring to FIGS. 10 and 11, the illumination assembly 300 includes a casing 302 having a first end portion 304 and a second end portion 306 distal to the first end portion 304. The first end portion 304 is pivotally connected to the upper edge portion 206*a*, so that the casing 302 is pivotally movable between a storage position 305 within the recess 212 (as shown in FIGS. 9 and 11) and a use position 307 out of the recess 212 (as shown in FIGS. 6 and 8). The casing 302 is rotatable through an arcuate path of approximately 270° between its storage position 305 and its use positions 307, as described above with respect to the casing 24 and as shown in FIG. 3.

Referring to FIGS. 9 and 11, the upper edge portion 206*a* may include a cutout portion 224 extending inwardly and toward the drawing surface 214, and be similarly configured to the cutout portion 36 as described above. Accordingly, the first end portion 304 of the casing 302 may be rotatably disposed within the cutout portion 224, and retained therein via first and second pivot posts 52, 56 received in corresponding first and second openings 44, 46 as described above and as shown in FIGS. 3-5. In addition, the axis of rotation R about which the casing 304 pivots is spaced from a periphery 226 of the upper edge portion 206*a*, so that the casing 304 does not extend outwardly from the periphery 226 when in its storage position 305. Thus, the possibility of damaging the illumination assembly 300 when in the storage position 305 is minimized.

Referring again to FIGS. 6 and 11, the casing 302 accommodates an illumination source 308, which illuminates at least a portion of the drawing surface 214 when the casing 302 is in its use position 307. In one embodiment, the illumination source 308 is disposed within a depression 310 extending into a front face 312 of the casing 302. The depression 310 may have a generally conical configuration for enhanced light dispersion. Preferably, the depression 310 and/or illumination source 308 is proximate the second end portion 306, so that the illumination source 308 is elevated from the magnetic drawing surface 214 when the illumination assembly 300 is in its use position 307. The casing 302 includes a curved lid or cover 309 (see FIG. 11) that is formed with the casing 302. The lid 309 prevents light from the source 308, such as an LED, from being directed at the user of the drawing assembly 100 when the illumination assembly 300 is in its use position 307.

Similar to drawing assembly 10, the drawing surface 214 of drawing assembly 100 may be located on a first plane P1 and the bottom surface 204 may be located on a second plane P2, with the illumination assembly 300 rotatable about an axis of rotation R, as illustrated in FIG. 4. Thus, the axis of rotation R of the illumination assembly 300 may be intermediate the first plane P1 and the second plane P2. Further, the axis R is preferably substantially parallel to the first plane P1. The front face 312 of the casing 302 may be located along a third plane P3 that is substantially perpendicular to the first plane P1 when the illumination assembly 300 is in its use position 307, and the third plane P3 is substantially parallel to the first plane P1 when the illumination assembly 300 is in its storage position 305, similar to that as described above and as shown in FIG. 4.

Referring again to FIGS. 6 and 11, the illumination assembly 300 may include an actuator 314 operable as a switch or input to control the illumination of the illumination source 308. Alternatively or in addition, an actuator may be coupled to the housing 200 and/or casing 302, which is automatically actuated and activates the illumination source 308 when the casing 302 is moved into its use position, and deactivates the illumination source 308 when the casing 302 is moved out of its use position.

Further, the illumination source 308 and drawing surface 214 may be coupled to a control circuit. The control circuit causes the illumination source 308 to be inactivated after a predetermined period of time. Any conventional control circuit may be used.

Figure 12:
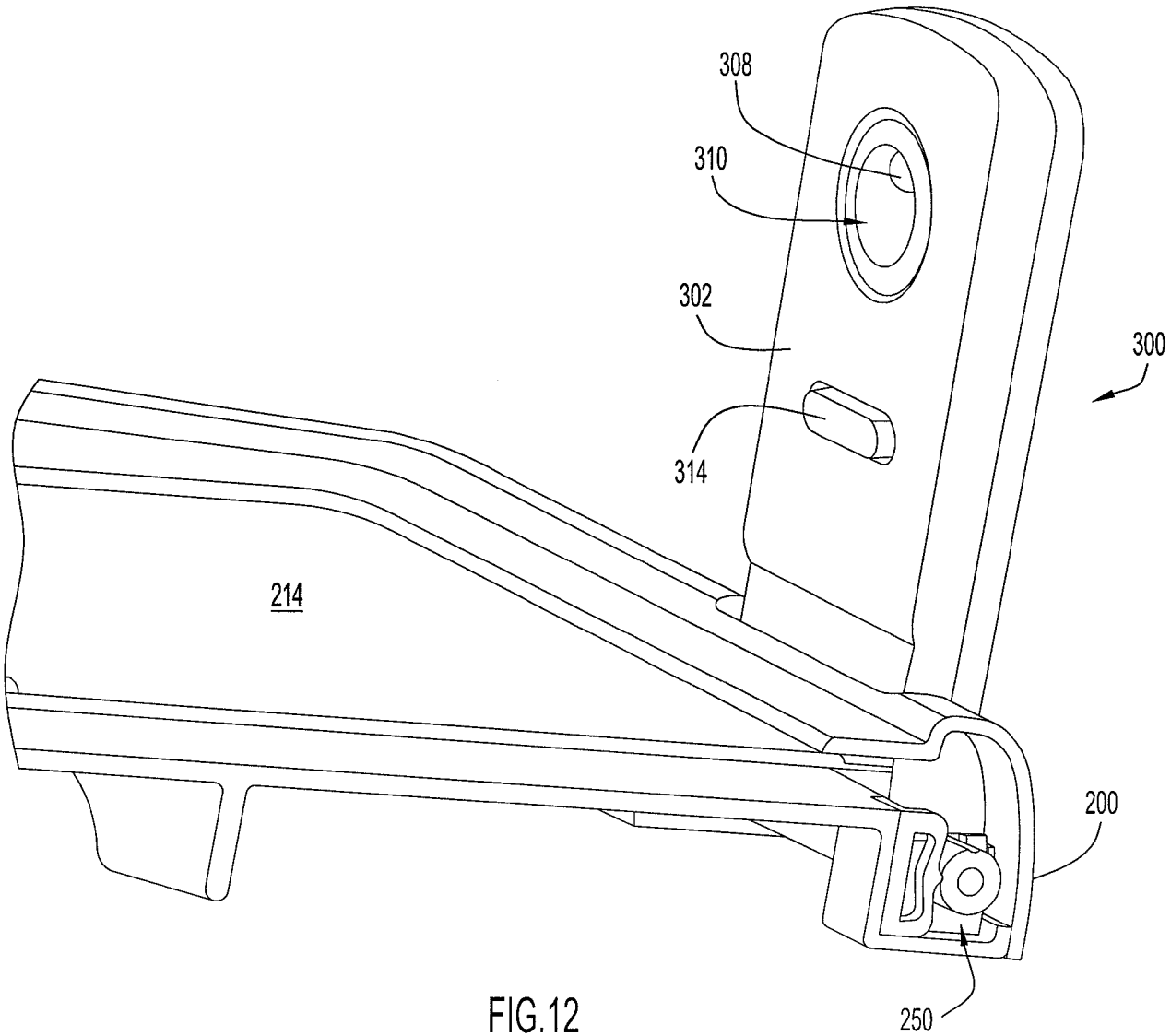
FIG. 12 illustrates a fragmentary sectional perspective view of portions of a drawing assembly showing a detent mechanism.
Figure 13:
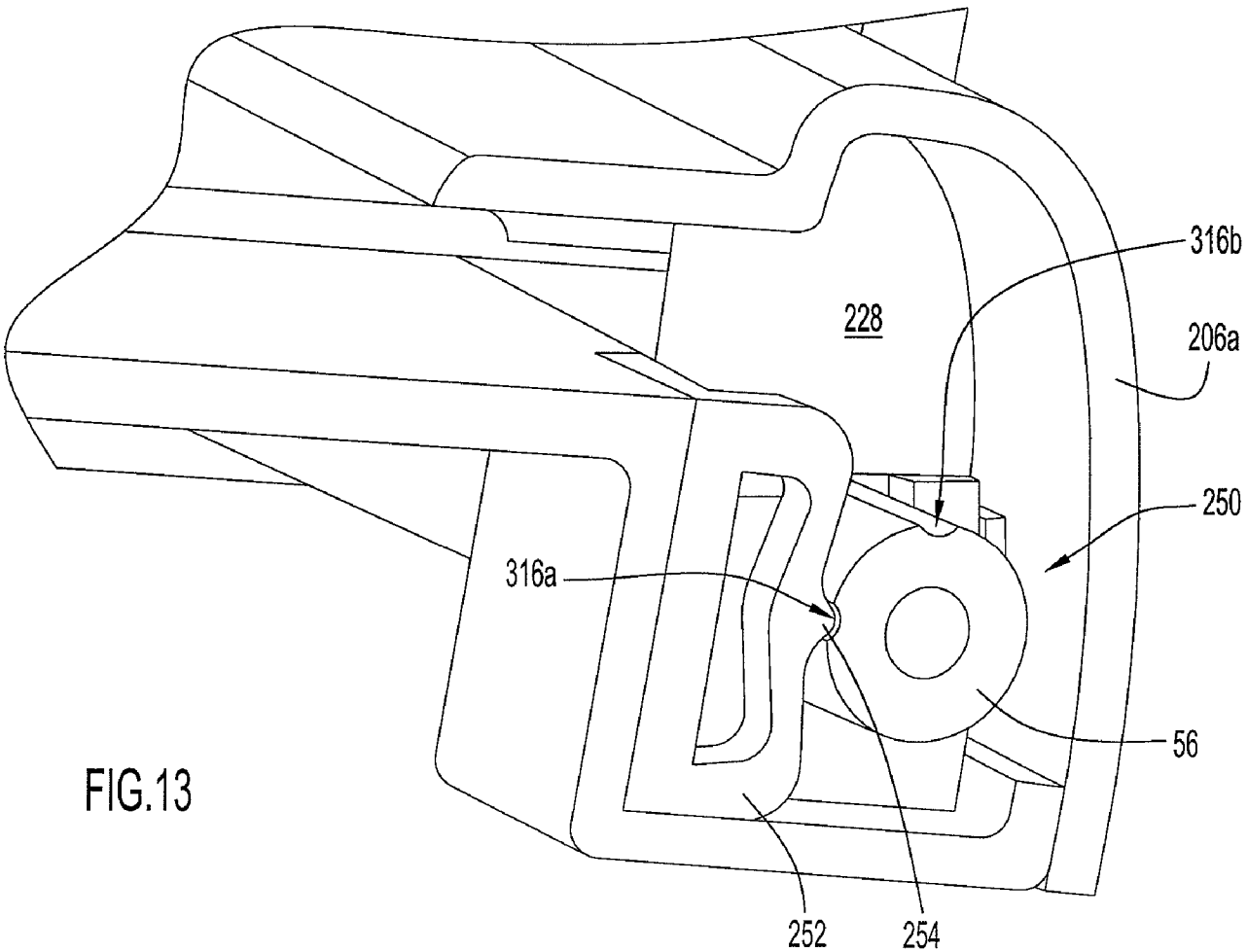
FIG. 13 illustrates an exploded perspective view of portions of the detent mechanism shown in FIG. 12.

Referring to FIGS. 12 and 13, a cross-sectional view of some of the components of the housing 200 are illustrated. The housing 200 may include a detent or locking mechanism 250 that releasably retains the casing 302 of the illumination assembly 300 in one or more selected positions along its arcuate path of motion. In this embodiment, the detent mechanism 250 releasably retains the casing 302 in the storage position and/or the use position.

In one embodiment, the detent mechanism 250 includes a resilient spring member 252 that has a protrusion 254 biased outwardly into an internal cavity 228 defined by the upper edge portion 206*a* and proximate to the cutout portion 224. One or more notches may be disposed in the corresponding pivot post 52 and/or 56. For example, as shown in FIG. 13, pivot post 56 may include a first notch 316*a* and a second notch 316*b*. The protrusion 254 is aligned with and received in a selected notch 316*a*, 316*b* upon rotation of the casing 302 to a predetermined position. For example, the protrusion 254 may be received in the first notch 316*a* when the casing 302 is pivoted to its use position (as shown in FIG. 12). The protrusion 254 may be received in the second notch 316*b* when the casing 302 is pivoted to its storage position. Thus, the first notch 316*a* and the second notch 316*b* may be radially spaced about the axis of rotation R and along the circumference of post 56 by an angle of approximately 270°.

In order to move the casing 302 out of either its use position or its storage position, sufficient pivotal force is applied to the case 302 to dislodge the protrusion 254 from the corresponding notch 316*a* or 316*b*, thereby compressing the resilient spring member 252. The spring force of the resilient member 252 should be sufficiently strong to maintain the casing 302 in the selected position (e.g. the use position or the storage position) such that the casing 302 will not easily pivot out of the selected position due to the forces of gravity or a force applied by a user or an object. However, a small child should be able to easily overcome the spring force of the resilient member 252 and dislodge the protrusion 254 from the corresponding notch 316*a* or 316*b* when pivotal movement of the casing 302 is desired.

The drawing assembly 100 (or 10) may include either one detent mechanism 250 disposed within the housing and adjacent one end of the cutout portion 224 (or 36). Alternatively, a first detent mechanism 250 may be provided on one end of the cutout portion 224 (or 36) and operable with the first pivot post 52, and a second identically configured detent mechanism 250 may be provided on the opposite end of the cutout portion 224 (or 36) and operable with the second pivot post 56.

It should be understood that the specific arrangement and configuration of the detent mechanism may vary. For example, the arrangement of the protrusion 254 and notch 316*a* and/or 316*b* may be reversed. In that implementation, the pivot post 52 and/or 56 includes one or more resilient protrusions that engage a notched member provided within the corresponding internal cavity within the edge portion 18, 206. Thus, other configurations of a detent mechanism for releasably retaining the casing 302 in one or more selected positions are possible, as would be readily understood by one skilled in the art.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A drawing assembly, comprising:

a housing having a first surface and a second surface opposite the first surface, the first surface is located along a first plane and includes a drawing surface, the second surface is located along a second plane, the housing includes an edge portion;

an illumination casing having a first end and a second end, the first end being pivotally connected proximate to the edge portion of the housing, the second end being distal to the first end, the illumination casing being pivotable through an arcuate path of approximately 270° about an axis located between the first plane and the second plane, and at least a portion of the illumination casing being located between the first plane and the second plane in a storage position; and an illumination source disposed within the illumination casing, the illumination source being positionable to provide illumination to the drawing surface.

2. The drawing assembly of claim 1, wherein the second surface includes the recess disposed therein, and the illumination casing is pivotally movable between a storage position within the recess and a deployed position out of the recess.

3. The drawing assembly of claim 2, wherein the drawing surface is located along the first plane, the illumination casing includes a front face located along a third plane, and the first plane is substantially perpendicular to the third plane when the illumination casing is in its deployed position.

4. The drawing assembly of claim 2, wherein the drawing surface is located along the first plane, the illumination casing includes a front face located along a third plane, and the first plane is substantially parallel to the third when the illumination casing is in its storage position.

5. The drawing assembly of claim 1, wherein the housing includes a detent mechanism that releasably retains the illumination casing in a selected position along the arcuate path.

6. The drawing assembly of claim 1, wherein the drawing surface is a magnetic drawing surface, and the drawing assembly further comprises:

a magnetic drawing implement operably associated with the magnetic drawing surface for creating images thereon.

7. The drawing assembly of claim 2, wherein the illumination casing in its storage position is placed within the housing.

8. A drawing assembly, comprising:

a housing having a first side and a second side opposite to the first side, the housing including a drawing surface disposed on the first side and a recess disposed in the second side, the housing including an edge portion, the drawing surface is located along a first plane, and the second side having a surface located along a second plane;

a casing pivotally connected to the edge portion of the housing and movable between a storage position within the recess and a deployed position, the casing is pivotable about an axis located between the first plane and the second plane, and at least a portion of the casing being located between the first plane and the second plane in the storage position; and an illumination source coupled to the casing, the illumination source illuminating at least a portion of the drawing surface when the casing is in its deployed position.

9. The drawing assembly of claim 8, wherein the housing includes a detent mechanism that releasably retains the casing in at least one of the storage position or the deployed position.

10. The drawing assembly of claim 8, wherein the casing in its deployed position is placed within the housing.

11. The drawing assembly of claim 8, wherein the casing is pivotable through an arcuate path of approximately 270° .

12. The drawing assembly of claim 8, wherein the drawing surface is a magnetic drawing surface.

13. The drawing assembly of claim 12, further comprising:

a magnetic drawing implement operably associated with the magnetic drawing surface for creating images thereon.

14. A magnetic drawing assembly, comprising:

a housing having a top surface located along a first plane and an opposite bottom surface located along a second plane, the top surface including a magnetic drawing surface, the bottom surface including a recess formed therein, the housing including an edge portion;

a magnetic drawing implement operably associated with the magnetic drawing surface for creating images thereon; and an illumination assembly movably connected to the edge portion of the housing and rotatable about an axis, the axis being intermediate the first plane and the second plane, and at least a portion of the illumination assembly being located between the first plane and the second plane in a storage position.

15. The magnetic drawing assembly of claim 14, wherein the illumination assembly includes a casing and an illumination source, the casing is pivotally connected to the edge portion of the housing and movable between the storage position within the recess and a use position, and the illumination source illuminating at least a portion of the magnetic drawing surface when the casing is in its use position.

16. The magnetic drawing assembly of claim 15, wherein the illumination assembly includes a front face located along a fourth plane, and the first plane is substantially perpendicular to the fourth plane when the illumination assembly is in its use position.

17. The magnetic drawing assembly of claim 15, wherein the casing is rotatable through an arcuate path of approximately 270° .

18. The magnetic drawing assembly of claim 14, wherein the housing includes a detent mechanism that releasably retains the illumination assembly in at least a first selected position.

* * * * *

UNITED STATES PATENT AND TRADEMARK OFFICE

CERTIFICATE OF CORRECTION

PATENT NO. : 8,256,937 B2
APPLICATION NO. : 12/547785
DATED : September 4, 2012
INVENTOR(S) : Bleyle et al.

It is certified that error appears in the above-identified patent and that said Letters Patent is hereby corrected as shown below:

Column 8, line 57, insert --plane-- between "third" and "when".

Signed and Sealed this
Fifth Day of February, 2013

Teresa Stanek Rea
*Acting Director of the United States Patent and Trademark Office*